US009030457B2

(12) United States Patent
Liu et al.

(10) Patent No.: US 9,030,457 B2
(45) Date of Patent: May 12, 2015

(54) DISPLAY WITH WIRELESS CHARGING FUNCTION, OPERATION METHOD THEREOF AND CORRESPONDING PORTABLE ELECTRONIC APPARATUS

(71) Applicant: AU Optronics Corp., Hsin-Chu (TW)

(72) Inventors: Jia-Wei Liu, Hsin-Chu (TW); Yueh-Han Li, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 206 days.

(21) Appl. No.: 13/757,943

(22) Filed: Feb. 4, 2013

(65) Prior Publication Data

US 2013/0328849 A1 Dec. 12, 2013

(30) Foreign Application Priority Data

Jun. 7, 2012 (TW) ..... 101120522 A

(51) Int. Cl.
*G09G 3/00* (2006.01)
*G09G 3/20* (2006.01)

(52) U.S. Cl.
CPC .. *G09G 3/00* (2013.01); *G09G 3/20* (2013.01); *G09G 2330/02* (2013.01); *G09G 2380/04* (2013.01)

(58) Field of Classification Search
CPC ..... G06F 3/041; G06F 3/037; G06F 3/048; H04Q 5/22; H01F 38/14; H02J 7/02; H02J 7/00
USPC ..... 320/108
See application file for complete search history.

(56) References Cited

U.S. PATENT DOCUMENTS 7,772,802 B2 * 8/2010 Manico et al. ..... 320/108
7,796,037 B2 * 9/2010 Bauchot et al. ..... 340/568.5
2009/0265662 A1 10/2009 Bamford et al.
2010/0176934 A1 7/2010 Chou et al.

(Continued)

FOREIGN PATENT DOCUMENTS

CN 2713659 Y 7/2005
CN 1746843 A 3/2006

(Continued)

OTHER PUBLICATIONS

China Patent Office, "Office Action", Apr. 1, 2014.

(Continued)

*Primary Examiner* — Andrew Sasinowski
(74) *Attorney, Agent, or Firm* — WPAT, PC; Justin King

(57) ABSTRACT

A display with wireless power charging function, an operation method thereof and a corresponding portable electronic apparatus are provided. The display includes a RFID read/write module and is applicable to electrically charge a portable electronic apparatus with a RFID tag. The operation method includes steps of: displaying an image on the display surface of the display panel of the display; transmitting data between the Radio Frequency Identification read/write module of the display and the Radio Frequency Identification tag of the portable electronic apparatus and electrically charging the energy storage unit of the portable electronic apparatus while the portable electronic apparatus is placed in the readable/writable area; and adjusting, while the portable electronic apparatus is placed in the readable/writable area, the image to an updated image having no overlap with the readable/writable area if the image has an overlap with the readable/writable area.

13 Claims, 5 Drawing Sheets

(56) References Cited

U.S. PATENT DOCUMENTS

| | | | | |
|---|---|---|---|---|
| 2010/0194206 | A1 | 8/2010 | Burdo et al. | |
| 2010/0213895 | A1 | 8/2010 | Keating et al. | |
| 2011/0096023 | A1 * | 4/2011 | Shih et al. ..... | 345/174 |

FOREIGN PATENT DOCUMENTS

| | | | |
|---|---|---|---|
| CN | 101669265 | A | 3/2010 |
| CN | 101783531 | A | 7/2010 |
| EP | 2112583 | | 10/2009 |

OTHER PUBLICATIONS

Taiwan Patent Office, "Office Action", May 21, 2014.

China Patent Office, "Office Action", Nov. 15, 2014.

* cited by examiner

DISPLAY WITH WIRELESS CHARGING FUNCTION, OPERATION METHOD THEREOF AND CORRESPONDING PORTABLE ELECTRONIC APPARATUS

TECHNICAL FIELD

The disclosure relates to a display technical field, and more particularly to a display with wireless charging function, an operation method thereof and a corresponding portable electronic apparatus.

BACKGROUND

In recent years, portable electronic devices are developed rapidly and widely used in people's daily life with the high demand for convenience.

However, these portable electronic devices may need either an adapter with power line or a Universal Serial Bus (USB) transmission line for the electrically charging; and this electrically charging manner is inconvenient to users.

SUMMARY OF EMBODIMENTS

Therefore, the present disclosure provides a display with wireless charging function capable of wirelessly electrically charging a portable electronic apparatus and preventing the image displayed thereon being blocked by the portable electronic apparatus.

The present disclosure further provides an operation method of a display with wireless charging function capable of wirelessly electrically charging a portable electronic apparatus and preventing the image displayed on the display from being blocked by the portable electronic apparatus.

The present disclosure still further provides a portable electronic apparatus applicable to be wirelessly electrically charged by the aforementioned display.

An embodiment of the disclosure provides a display with wireless power charging function applicable to electrically charge a portable electronic apparatus with a Radio Frequency Identification tag. The Radio Frequency Identification tag is electrically connected to a power supply unit of the portable electronic apparatus. The power supply unit includes an energy storage unit configured to supply an operation power to the portable electronic apparatus. The display includes a display panel with a display surface, a Radio Frequency Identification read/write module and a control module. The Radio Frequency Identification read/write module is configured to transmit/receive data to/from the portable electronic apparatus through the Radio Frequency Identification tag and electrically charge the energy storage unit of the portable electronic apparatus. The Radio Frequency Identification read/write module is disposed at a predetermined position on the display panel, and a readable/writable area is defined on the display surface based on a communicable range of the Radio Frequency Identification read/write module and the portable electronic apparatus. The readable/writable area and a portion of the display surface overlap. The control module is electrically connected between the display panel and the Radio Frequency Identification read/write module and configured to drive the display panel to display an image on the display surface. The control module is further configured to, when the data transmission between the Radio Frequency Identification read/write module of the display and the Radio Frequency Identification tag of the portable electronic apparatus as well as the electrically charging of the portable electronic apparatus are being performed while the portable electronic apparatus is placed in the readable/writable area, drive the display panel to adjust the image to an updated image if the image has an overlap with the readable/writable area, the updated image is adjusted to have an overlap with the readable/writable area.

Another embodiment of the disclosure provides an operation method of a display with wireless power charging function. The display being is applicable to electrically charge a portable electronic apparatus with a Radio Frequency Identification tag. The Radio Frequency Identification tag is electrically connected to a power supply unit of the portable electronic apparatus. The power supply unit includes an energy storage unit configured to supply an operation power to the portable electronic apparatus. The display includes a display panel with a display surface and a Radio Frequency Identification read/write module. The Radio Frequency Identification read/write module is disposed at a predetermined position on the display panel, and a readable/writable area is defined on the display surface based on a communicable range of the Radio Frequency Identification read/write module and the portable electronic apparatus. The readable/writable area and a portion of the display surface overlap. The operation method includes steps of: displaying an image on the display surface of the display panel of the display; transmitting data between the Radio Frequency Identification read/write module of the display and the Radio Frequency Identification tag of the portable electronic apparatus and electrically charging the energy storage unit of the portable electronic apparatus while the portable electronic apparatus is placed in the readable/writable area; and adjusting, while the portable electronic apparatus is placed in the readable/writable area, the image to an updated image having no overlap with the readable/writable area if the image has an overlap with the readable/writable area.

Still another embodiment of the disclosure provides a portable electronic apparatus applicable to transmit/receive data to/from and receive electrical power from a display with wireless power charging function. The portable electronic apparatus includes a Radio Frequency Identification tag and a power supply unit. The Radio Frequency Identification tag is configured to issue an identification signal to the display so as to indicate the apparatus size of the portable electronic apparatus. The power supply unit includes an AC-DC conversion unit and an energy storage unit. The AC-DC conversion unit is electrically connected to the Radio Frequency Identification tag. The energy storage unit is electrically connected to the AC-DC conversion unit and configured to supply an electrical power for an operation of the portable electronic apparatus.

In summary, the display according to the present disclosure is capable of electrically charging a portable electronic apparatus with a RFID tag by disposing a RFID read/write module therein. In addition, the display is also capable of adjusting, while the portable electronic apparatus is placed in a readable/writable area of the display and being electrically charged by the display, an image to an updated image having no overlap with the readable/writable area if the image has an overlap with the readable/writable area. Thus, the display according to the present disclosure not only can wirelessly electrically charge a portable electronic apparatus, but also can prevent the image displayed thereon from being blocked by the portable electronic apparatus.

BRIEF DESCRIPTION OF THE DRAWINGS

The above embodiments will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of preferred embodiments are presented herein for purpose of illustration and description only. It is not intended to be exhaustive or to be limited to the precise form disclosed.

Figure 1:
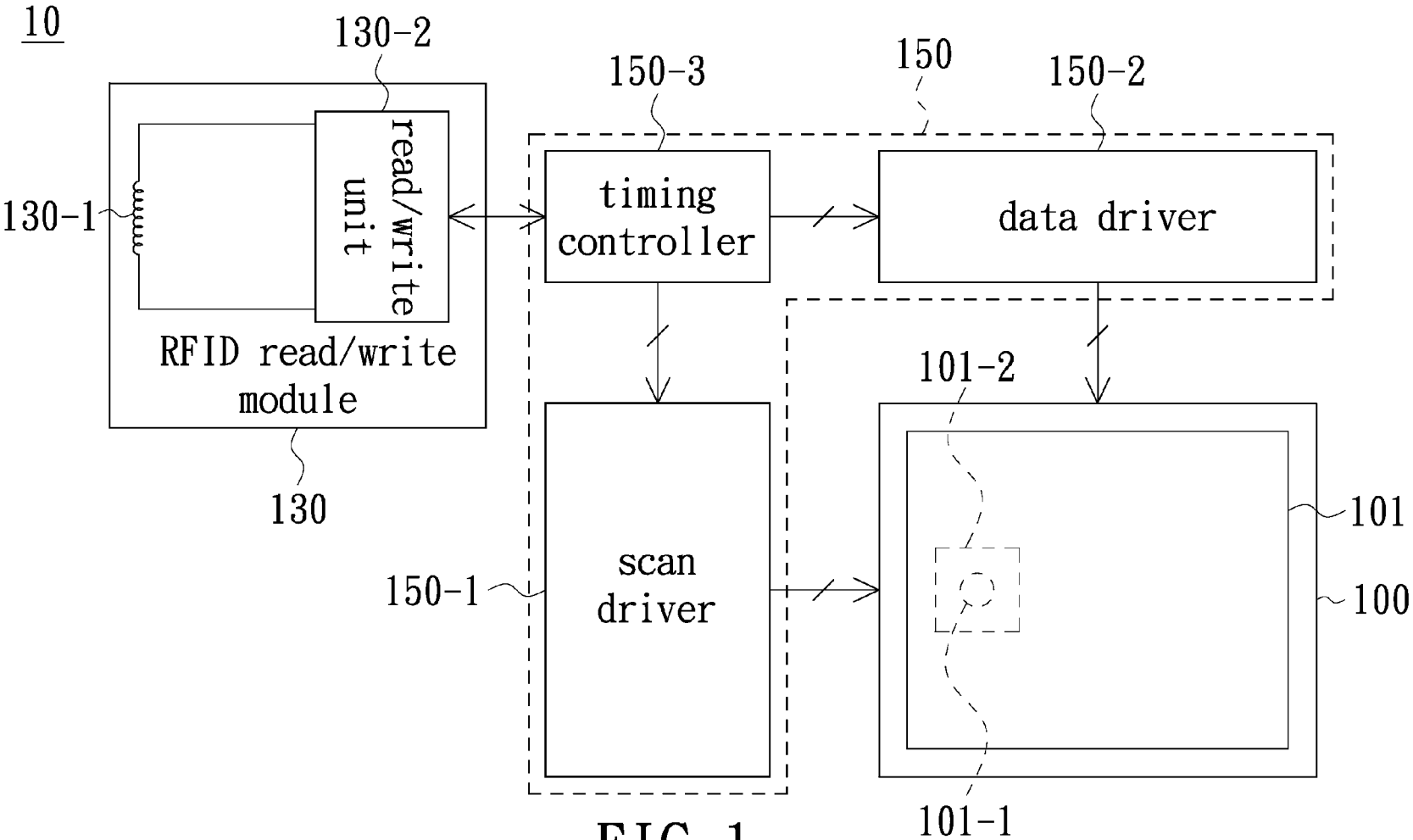
FIG. 1 is a schematic view of a display with wireless power charging function in accordance with an embodiment of the present disclosure.
Figure 2:
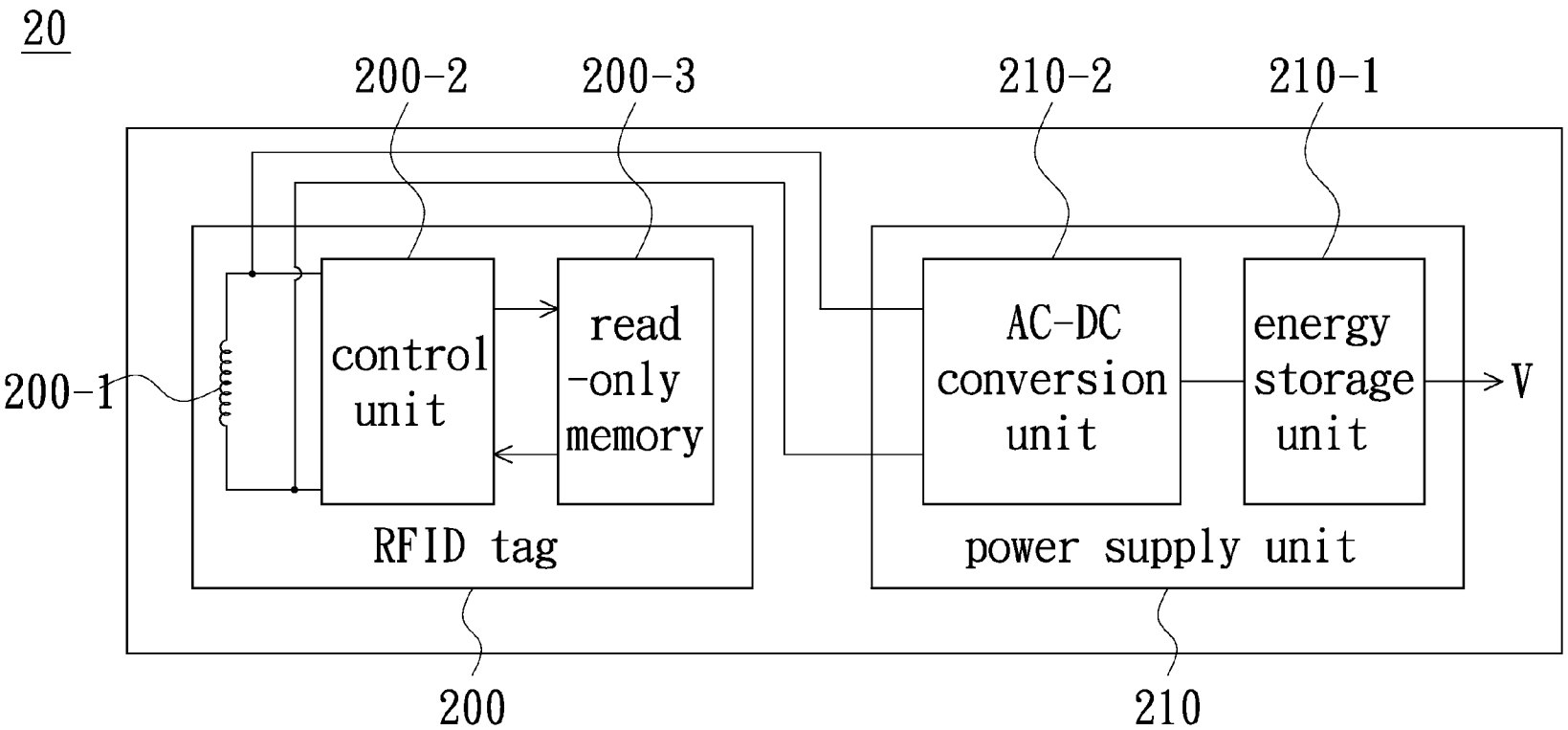
FIG. 2 is a schematic view of a portable electronic apparatus in accordance with an embodiment of the present disclosure.

FIG. 1 is a schematic view of a display with wireless power charging function in accordance with an embodiment of the present disclosure; and FIG. 2 is a schematic view of a portable electronic apparatus applicable for use with the display with wireless power charging function depicted in FIG. 1 in accordance with an embodiment of the present disclosure. Please refer to FIGS. 1, 2 both. The display 10 in this embodiment is applicable to electrically charge the portable electronic apparatus 20. Specifically, the portable electronic apparatus 20 includes a Radio Frequency Identification (RFID) tag 200 and a power supply unit 210 electrically connected to each other. The power supply unit 210 includes an energy storage unit 210-1, which is configured to supply an electrical power V for an operation of the portable electronic apparatus 20.

The display 10 includes a display panel 100 with a display surface 101, a RFID read/write module 130 and a control module 150. In this embodiment, the RFID read/write module 130 is configured to transmit/receive data to/from the portable electronic apparatus 20 through the RFID tag 200 thereof and electrically charge the energy storage unit 210-1 of the portable electronic apparatus 20. The RFID read/write module 130 is disposed at a predetermined position 101-1 on the display panel 100, and a readable/writable area 101-2 is defined on the display panel 100 based on a communicable range of the RFID read/write module 130 and the portable electronic apparatus 20 (specifically, the RFID tag 200); wherein it is understood that the readable/writable area 101-2 and a portion of the display surface 101 overlap. Specifically, the data transmission between the RFID read/write module 130 of the display 10 and the RFID tag 200 of the portable electronic apparatus 20 as well as the electrically charging of the portable electronic apparatus 20 can be performed only when the portable electronic apparatus 20 is placed in the readable/writable area 101-2; in other words, the RFID read/write module 130 is not able to, due to being out of the communicable range, transmit/receive data to/from the portable electronic apparatus 20 through the RFID tag 200 and electrically charge the energy storage unit 210-1 of the portable electronic apparatus 20, if the portable electronic apparatus 20 is placed out of the readable/writable area 101-2.

The control module 150 is electrically connected between the display panel 100 and the RFID read/write module 130 and is configured to drive the display panel 100 to display images on the display surface 101. In this embodiment, the control module 150 is further configured to, when the data transmission between the RFID read/write module 130 of the display 10 and the RFID tag 200 of the portable electronic apparatus 20 as well as the electrically charging of the portable electronic apparatus 20 are being performed while the portable electronic apparatus 20 is placed in the readable/writable area 101-2, drive the display panel 100 to adjust an image to an updated image if this image has an overlap with the readable/writable area 101-2; wherein the updated image is adjusted to have no overlap with the readable/writable area 101-2. In addition, the control module 150 includes a scan driver (also referred to as a gate driver) 150-1, a data driver (also referred to as a source driver) 150-2 and a timing controller 150-3. The scan driver 150-1 and the data driver 150-2 both are electrically connected to the display panel 100; and the timing controller 150-3 is electrically connected to the scan driver 150-1, the data driver 150-2 and the RFID read/write module 130. The scan driver 150-1 is configured to sequentially update the pixels (not shown) of the display panels 100; the data driver 150-2 is configured to provide the display data required by the display panel 100 for the image updating; and the timing controller 150-3 is configured to control the scan driver 150-1 and the data driver 150-2.

In this embodiment, the RFID read/write module 130 includes a coil 130-1 and a read/write unit 130-2; wherein the read/write unit 130-2 is electrically connected to the coil 130-1, the timing controller 150-3 and an internal power source (not shown) of the display 10. Specifically, the coil 130-1 of the RFID read/write module 130 is configured to, corporately with a corresponding coil 200-1 of the RFID tag 200, perform a magnetic field coupling resonance operation; wherein the two coils 130-1, 200-1 are configured to have a magnetic field coupling resonance of 150~250 kHz; and the disclosure is not limited thereto.

The portable electronic apparatus 20 is applicable to transmit/receive data to/from as well as receive electrical power from the display 10 with wireless power charging function. In this embodiment, the RFID tag 200 of the portable electronic apparatus 20 further, besides the coil 200-1, includes a control unit 200-2 and a read-only memory 200-3; wherein the control unit 200-2 is electrically connected between the coil 200-1 and the read-only memory 200-3. The control unit 200-2 is configured to perform some specific operations, such as the signal authentication, signal computation, signal anti-collision, signal encryption or signal read/write operations. The read-only memory 200-3 (e.g., an electrically erasable rewritable read-only memory) is configured to store the class information and/or the model information of the portable electronic apparatus 20. In this embodiment, the power supply unit 210 further, besides the energy storage unit 210-1, includes an AC-DC conversion unit 210-2 which is electrically connected between the coil 200-1 and the energy storage unit 210-1 and is configured to receive the AC electrical power from the coil 200-1, convert the AC electrical power into a DC electrical power, and provide the DC electrical power to the energy storage unit 210-1.

In one embodiment, the data transmitted between the RFID read/write module 130 of the display 10 and the RFID tag 200 of the portable electronic apparatus 20 include an identification signal, which is issued from the RFID tag 200 to the RFID read/write module 130 and carries the aforementioned class information and/or the model information of the portable electronic apparatus 20. And thus, the RFID read/write module 130 can, once receiving the identification signal, determine the apparatus size of the portable electronic devices 20 according to the class information and/or the model information carried in the identification signal and then inform the determination result to the timing controller 150-3; and accordingly the timing controller 150-3 can determine the size of the updated image required to be adjusted.

It is to be noted that the data transmitted between the RFID read/write module 130 of the display 10 and the RFID tag 200 of the portable electronic apparatus 20 may further include a request signal, which is issued from the RFID read/write module 130 to the RFID tag 200 and is used to request for the identification signal. And it is understood that the RFID tag 200 issues the identification signal to the RFID read/write module 130 in response to the request signal.

In addition, the RFID read/write module 130 may be further configured to, before the apparatus size of the portable electronic apparatus 20 is determined according to the identification signal, determine whether or not the identification signal is valid. In other words, the RFID read/write module 130 may first determine, according to the identification signal, whether or not the portable electronic apparatus 20 belongs to a predetermined identification group of the RFID read/write module 130 and accordingly determine the follow-up operation on the portable electronic apparatus 20 according to the determination result; wherein the predetermined identification group includes the types, models or categories of a variety of predetermined portable electronic apparatuses. In particular, the display 10 is configured to perform a power transmission so as to electrically charge the energy storage unit 210-1 of the portable electronic apparatus 20 only if the portable electronic apparatus 20 is in the predetermined identification group; alternatively, the display 10 does not electrically charge the energy storage unit 210-1 of the portable electronic apparatus 20 if the portable electronic apparatus 20 is not in the predetermined identification group. Thus, through the aforementioned determination mechanism, a portable electronic apparatus not in the predetermined identification group can be prevented from being damaged by being electrically charged improperly.

Figure 3A:
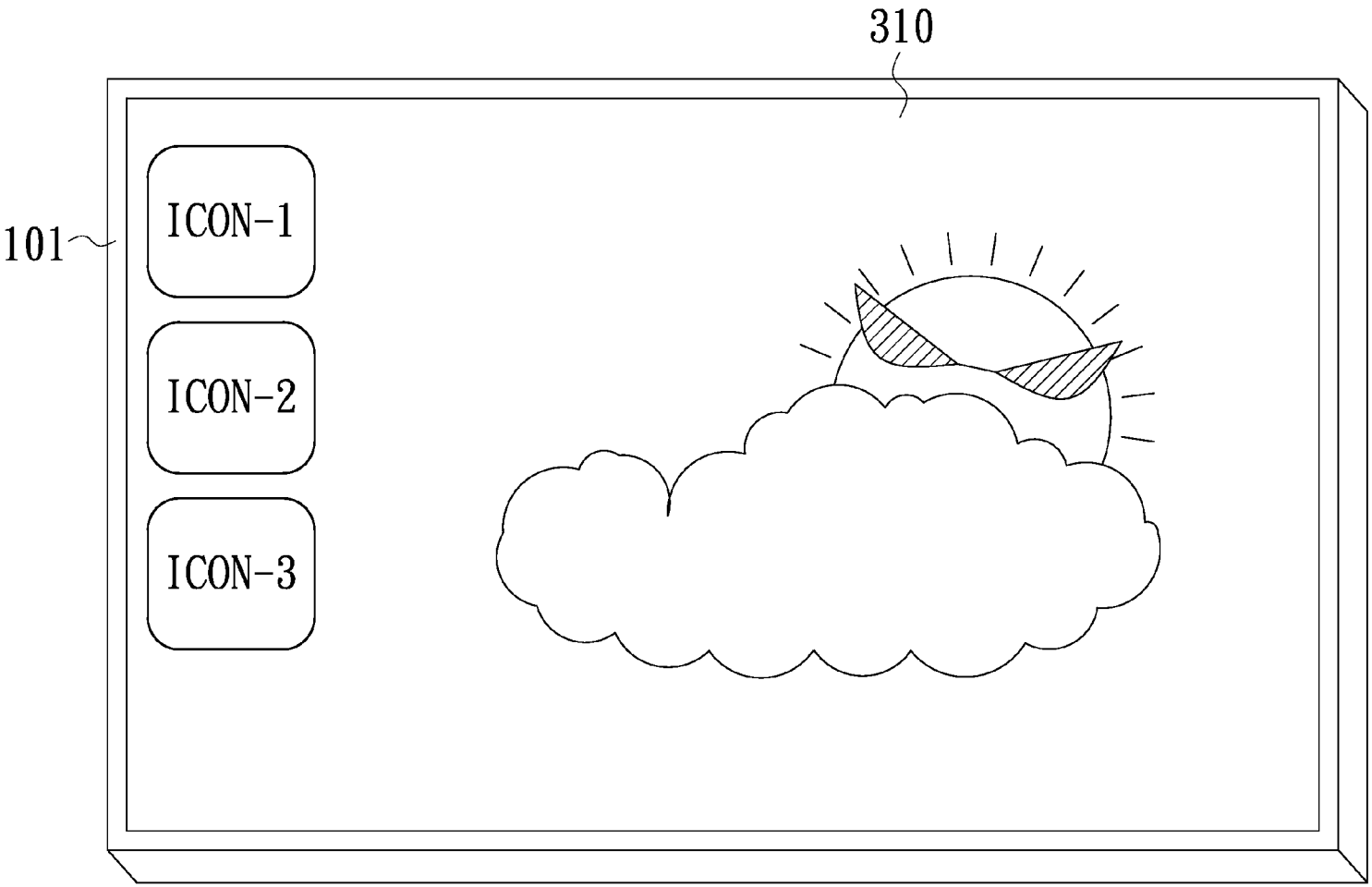
FIG. 3A is a schematic view illustrating an image before being adjusted to an updated image.
Figure 3B:
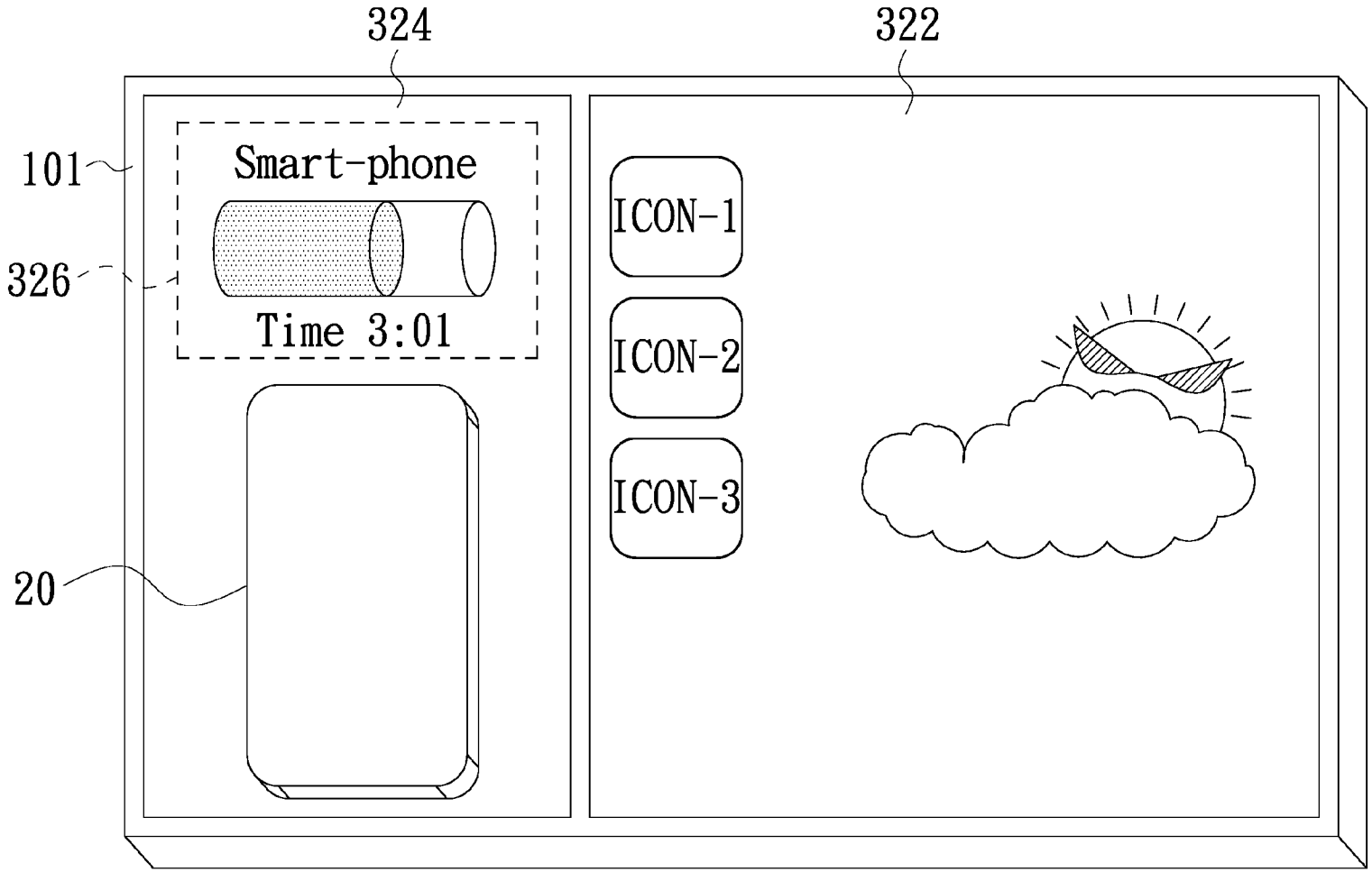
FIG. 3B is a schematic view illustrating the updated image, which is adjusted from the image shown in FIG. 3A.

FIG. 3A is a schematic view illustrating the image before being adjusted to the updated image. As shown, the image 310, to be displayed on the display surface 101 of the display panel 100, is a full-screen image and includes a plurality of (for example, three) graphical interfaces ICON-1, ICON-2 and ICON-3. FIG. 3B is a schematic view illustrating the updated image, which is adjusted from the image 310 shown in FIG. 3A. As shown, the three graphical interfaces ICON-1, ICON-2 and ICON-3 are still contained in the updated image 322, which is adjusted from the image 310 and displayed on the display surface 101 of the display panel 100. In other words, the image 310, due to having an overlap with the readable/writable area 101-2 and accordingly a portion thereof will be blocked by the portable electronic apparatus 20 placed in the readable/writable area 101-2, is required to be adjusted to the updated image 322, which has a size smaller than the image 310 has and there is no overlap between the updated image 322 and the readable/writable area 101-2. Thus, all the information contained in the image 310 can be delivered by the updated image 322 without any blocking by the portable electronic apparatus 20.

In one embodiment, the timing controller 150-3 is configured to reduce the resolution of the image 310 so as to form the reduced-sized updated image 322; wherein the updated 322 is required to have no overlap with the readable/writable area 101-2 of the display 10 as mentioned above. Moreover, in another embodiment the timing controller 150-3, while reducing the size of the image 310 to form the updated image 322, is further configured to reallocate positions of these three graphical interfaces ICON-1, ICON-2 and ICON-3 in the updated image 322; thus, the three graphical interfaces ICON-1, ICON-2 and ICON-3 can have a proper arrangement in the updated image 322 and users can observe and use these three graphical interfaces ICON-1, ICON-2 and ICON-3 more conveniently.

Please refer to FIG. 3B again. In another embodiment, the data transmitted between the RFID read/write module 130 of the display 10 and the RFID tag 200 of the portable electronic apparatus 20 may further include a charging status signal, which is issued from the RFID tag 200 to the RFID read/write module 130 and associated with the charging status of the energy storage unit 210-1. Thus, the timing controller 150-3 can, according to the charging status signal, display a charging status image 324 of the portable electronic apparatus 20 (for example, a smart-phone) on a side of the updated image 322 on the display surface 101; wherein the charging status image 324 include information 326 for indicating the remaining electrical power and/or the estimating charging time of the energy storage unit 210-1.

Figure 4:
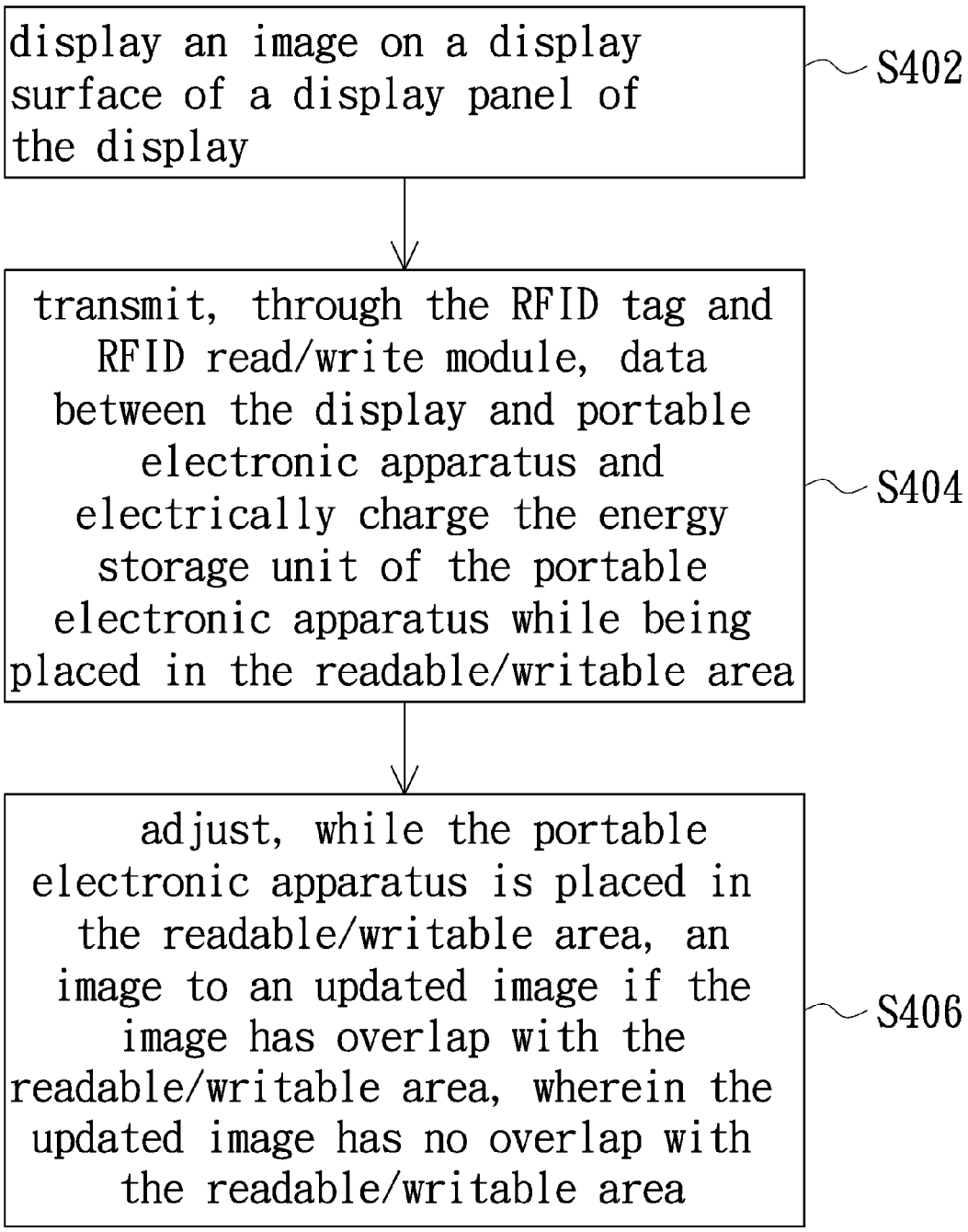
FIG. 4 is an operation method of a display with wireless charging function in accordance with an embodiment of the present disclosure.

The operation of the display with wireless charging function according to the present disclosure can be summarized to some basic operation steps by those ordinarily skilled in the art. FIG. 4 is an operation method of a display with wireless charging function in accordance with an embodiment of the present disclosure; wherein the display is applicable to electrically charge a portable electronic apparatus with a RFID tag. Specifically, the RFID tag is electrically connected to a power supply unit of the portable electronic apparatus; and the power supply unit includes an energy storage unit configured to supply an operation power to the portable electronic apparatus. The display includes a display panel with a display surface and a RFID read/write module. The RFID read/write module is disposed at a predetermined position on the display panel, and a readable/writable area is defined on the display surface based on a communicable range of the RFID read/write module and the portable electronic apparatus; wherein the readable/writable area and a portion of the display surface overlap. The operation method includes steps of: displaying an image on the display surface of the display panel of the display (step S402); transmitting data between the RFID read/write module of the display and the RFID tag of the portable electronic apparatus and electrically charging the energy storage unit of the portable electronic apparatus while the portable electronic apparatus is placed in the readable/writable area (step S404); and adjusting, while the portable electronic apparatus is placed in the readable/writable area, the image to an updated image having no overlap with the readable/writable area if the image has an overlap with the readable/writable area (step S406).

In summary, the display according to the present disclosure is capable of electrically charging a portable electronic apparatus with a RFID tag by disposing a RFID read/write module therein. In addition, the display is also capable of adjusting, while the portable electronic apparatus is placed in a readable/writable area of the display and being electrically charged by the display, an image to an updated image having no overlap with the readable/writable area if the image has an overlap with the readable/writable area. Thus, the display according to the present disclosure not only can wirelessly electrically charge a portable electronic apparatus, but also can prevent the image displayed thereon from being blocked by the portable electronic apparatus.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display with wireless power charging function applicable to electrically charge a portable electronic apparatus with a Radio Frequency Identification tag, the Radio Frequency Identification tag being electrically connected to a power supply unit of the portable electronic apparatus, the power supply unit comprising an energy storage unit configured to supply an operation power to the portable electronic apparatus, the display comprising:

a display panel with a display surface;

a Radio Frequency Identification read/write module configured to transmit/receive data to/from the portable electronic apparatus through the Radio Frequency Identification tag and electrically charge the energy storage unit of the portable electronic apparatus, wherein the Radio Frequency Identification read/write module is disposed at a predetermined position on the display panel, and a readable/writable area is defined on the display surface based on a communicable range of the Radio Frequency Identification read/write module and the portable electronic apparatus, the readable/writable area and a portion of the display surface overlap; and a control module electrically connected between the display panel and the Radio Frequency Identification read/write module and configured to drive the display panel to display an image on the display surface, wherein the control module is further configured to, when the data transmission between the Radio Frequency Identification read/write module of the display and the Radio Frequency Identification tag of the portable electronic apparatus as well as the electrically charging of the portable electronic apparatus are being performed while the portable electronic apparatus is placed in the readable/writable area, drive the display panel to adjust the image to an updated image if the image has an overlap with the readable/writable area, the updated image is adjusted to have no overlap with the readable/writable area;

wherein the data transmitted between the Radio Frequency Identification read/write module of the display and the Radio Frequency Identification tag of the portable electronic apparatus includes an identification signal issued from the Radio Frequency Identification tag to the Radio Frequency Identification read/write module, the identification signal is used to determine the apparatus size of the portable electronic apparatus.

2. The display according to claim 1, wherein the control module comprises:

a scan driver electrically connected to the display panel;

a data driver electrically connected to the display panel; and a timing controller electrically connected to the scan driver, the data driver and the Radio Frequency Identification read/write module and configured to, through the scan driver and the data driver, drive the display panel.

3. The display according to claim 2, wherein the timing controller reduces the size of the image by reducing the resolution thereof and thereby forming the updated image, and the timing controller is further configured to, while reducing the size of the image, reallocate positions of a plurality of graphical interfaces in the image.

4. The display according to claim 2, wherein the data transmitted between the Radio Frequency Identification read/write module of the display and the Radio Frequency Identification tag of the portable electronic apparatus include a charging status signal issued from the Radio Frequency Identification tag to the Radio Frequency Identification read/write module, and the timing controller is further configured to, according to the charging status signal, display a charging status image of the portable electronic apparatus on a side of the updated image, the charging status image includes information for indicating the remaining electrical power and/or the estimating charging time of the energy storage unit.

5. The display according to claim 1, wherein the control module is further configured to, based on the apparatus size of the portable electronic apparatus, determine the size of the updated image.

6. The display according to claim 1, wherein the data transmitted between the Radio Frequency Identification read/write module of the display and the Radio Frequency Identification tag of the portable electronic apparatus include a request signal issued from the Radio Frequency Identification read/write module to the Radio Frequency Identification tag, the Radio Frequency Identification tag issues the identification signal in response to the request signal.

7. The display according to claim 1, wherein the Radio Frequency Identification read/write module is further configured to, before the apparatus size of the portable electronic apparatus is determined according to the identification signal, determine whether or not the identification signal is valid and thereby further determining whether or not the portable electronic apparatus belongs to a predetermined identification group of the Radio Frequency Identification read/write module.

8. An operation method of a display with wireless power charging function, the display being applicable to electrically charge a portable electronic apparatus with a Radio Frequency Identification tag, the Radio Frequency Identification tag being electrically connected to a power supply unit of the portable electronic apparatus, the power supply unit comprising an energy storage unit configured to supply an operation power to the portable electronic apparatus, the display comprising a display panel with a display surface and a Radio Frequency Identification read/write module, the Radio Frequency Identification read/write module being disposed at a predetermined position on the display panel, and a readable/writable area is defined on the display surface based on a communicable range of the Radio Frequency Identification read/write module and the portable electronic apparatus, the readable/writable area and a portion of the display surface overlapping, the operation method comprising:

displaying an image on the display surface of the display panel of the display;

transmitting data between the Radio Frequency Identification read/write module of the display and the Radio Frequency Identification tag of the portable electronic apparatus and electrically charging the energy storage unit of the portable electronic apparatus while the portable electronic apparatus is placed in the readable/writable area; and adjusting, while the portable electronic apparatus is placed in the readable/writable area, the image to an updated image having no overlap with the readable/writable area if the image has an overlap with the readable/writable area so as to reduce the size of the image by reducing the resolution thereof and thereby forming the update image by reducing the size of the image and reallocating positions of a plurality of graphical interfaces in the image.

9. The operation method according to claim 8, further comprising:

determining the size of the updated image based on the apparatus size of the portable electronic apparatus.

10. The operation method according to claim 8, further comprising:

issuing an identification signal from the Radio Frequency Identification tag to the Radio Frequency Identification read/write module, wherein the identification signal is used to determine the apparatus size of the portable electronic apparatus.

11. The operation method according to claim 10, further comprising:

issuing a request signal from the Radio Frequency Identification read/write module to the Radio Frequency Identification tag, wherein the Radio Frequency Identification tag issues the identification signal in response to the request signal.

12. The operation method according to claim 10, further comprising:

determining, before the apparatus size of the portable electronic apparatus is determined according to the identification signal, whether or not the identification signal is valid and thereby further determining whether or not the portable electronic apparatus belongs to a predetermined identification group of the radio frequency identification read/write module.

13. The operation method according to claim 8, further comprising:

issuing, while the energy storage unit is being electrically charged, a charging status signal from the Radio Frequency Identification tag to the Radio Frequency Identification read/write module; and displaying, according to the charging status signal, a charging status image of the portable electronic apparatus on a side of the updated image, wherein the charging status image includes information for indicating the remaining electrical power and/or the estimating charging time of the energy storage unit.

* * * * *